US005813375A

United States Patent [19]

Taylor

[11] Patent Number: 5,813,375

[45] Date of Patent: Sep. 29, 1998

[54] METHOD AND SYSTEM FOR DISTRIBUTING VAPORS OR GASES TO EACH CYLINDER OF A MULTICYLINDER ENGINE

[75] Inventor: Alan R. Taylor, Clarkston, Mich.

[73] Assignee: Siemenselectric Limited, Windsor, Canada

[21] Appl. No.: 613,565

[22] Filed: Mar. 11, 1996

[51] Int. Cl.[6] ..... F02M 35/10

[52] U.S. Cl. ..... 123/73 A; 123/468; 123/520

[58] Field of Search ..... 123/520, 516, 123/514, 518, 521, 568, 73 A, 468

[56] References Cited

U.S. PATENT DOCUMENTS

| | | | |
|---|---|---|---|
| 4,922,866 | 5/1990 | Staerzl | 123/73 A |
| 5,003,933 | 4/1991 | Rush | 123/568 |
| 5,005,535 | 4/1991 | Binversie | 123/73 A |
| 5,014,654 | 5/1991 | Ishibashi | 123/568 |
| 5,022,355 | 6/1991 | Billingsley | 123/73 C |
| 5,063,887 | 11/1991 | Ozawa | 123/73 C |
| 5,427,080 | 6/1995 | Maeda | 123/568 |

*Primary Examiner*—Carl S. Miller

[57] ABSTRACT

A multicylinder internal combustion engine has an intake manifold with one or more auxiliary fluid distribution networks for directing byproduct fluids to each cylinder to insure balanced flow. The byproduct fluids include crankcase vapors and fuel vapors from an adsorption canister, and recirculated exhaust gas. The crankcase and purge vapors are mixed in a common network of flow passages formed by grooves formed into the face of an intake manifold mounting flange, with the exhaust gas in a separate sealed network of grooves. Assist air flow to the injector ports is directed through yet another network of grooves in the flange face.

8 Claims, 3 Drawing Sheets

12
10
14
14
16
20
22
24
24
24
24
32
36
36
36
36
36
36

METHOD AND SYSTEM FOR DISTRIBUTING VAPORS OR GASES TO EACH CYLINDER OF A MULTICYLINDER ENGINE

BACKGROUND OF THE INVENTION

Modern automotive engines are often designed so that various vapors and/or gases generated as a byproduct of engine operation are drawn back into the air flow in the intake manifold, the byproduct vapors and/or gases are mixed into the intake air flow to be burned in the engine. This is done in order to reduce polluting emissions otherwise occurring during operation of the automobile.

For example, crankcase vapors are caused to flow through an external hose and PCV valve into the intake manifold at a point just below the throttle plate, where the vapors are mixed with air flow drawn into the engine cylinders.

Fuel vapor emissions from the fuel tank during fueling and also during engine operation are currently contained by use of a fuel vapor adsorbing canister, which is connected to the fuel tank to receive displaced fuel vapors. The adsorbed fuel vapor in the canister is periodically purged from the canister by being drawn into the intake manifold via an external hose and purge control solenoid.

Exhaust gas recirculation is another measure used to reduce the emission of oxides of nitrogen, a portion of the exhaust gas recirculated back into the intake manifold in order to be mixed into the combustible mixture for induction into the engine cylinders.

Air assist fuel injection is a recent innovation which directs an auxiliary air flow to the fuel injectors which is directed into the fuel spray from each injector to improve the atomization of the injected fuel.

The auxiliary air is currently supplied via an external air rail which receives air flow from an air pump, or which is induced by a vacuum from the intake manifold.

The prior art distribution method for recirculating byproduct fluids such as crankcase vapors, canister purge fuel vapor, and exhaust gas does not produce an exact uniformity of the air-fluid mixture drawn into each individual cylinder of a multicylinder engine. This is because these fluids are introduced into the intake manifold upstream of the manifold runners, and disproportionate flow of the added fluid in the individual runners may occur due to a variety of local flow conditions in each runner.

While design efforts are made to insure that these fluids are thoroughly mixed into the manifold air flow, some cylinder-to-cylinder variations in the mixture as received into the various cylinders inevitably occurs as noted.

Sophisticated engine controls rely on an $O_2$ sensor detecting the oxygen content of the exhaust to produce a constant optimal air-to-fuel ratio by varying the volume of fuel injected by the fuel injectors as the $O_2$ sensor signals indicate a shift in the air-to-fuel ratio. This control thereby minimizes engine emissions by operating as closely as possible to the desired air-to-fuel ratio at all times. The $O_2$ sensor detects the average level of oxygen in the exhaust gases. Increasingly stringent emission standards make it desirable that an exact air-to-fuel ratio be maintained as much as possible. The uneven volume of the byproduct vapors and gases introduced into each cylinder results in the actual air-to-fuel ratio varying considerably due to the effect of cylinder-to-cylinder distribution of crankcase vapors, purge vapors, and exhaust gases so that higher emission levels will likely result.

An additional disadvantage of prior art air assist systems is that extensive external plumbing is required for directing the air assist flow to the injectors adding to the cost and complexity of the engine.

An object of the present invention is to provide an auxiliary flow distribution system providing improved cylinder-to-cylinder distribution of the volume of byproduct fluids drawn into the cylinders of a multicylinder engine.

It is another object to provide such an auxiliary flow distribution system which is also capable of directing air assist flow to each fuel injector with minimal cost and complexity.

It is still another object to provide such a low cost, simplified fluid distribution system in combination with an engine intake manifold.

SUMMARY OF THE INVENTION

These and other objects of the present invention, which will become apparent upon a reading of the following specification and claims, are achieved by a method and system using one or more networks of auxiliary flow passages formed into the flange portion of an intake manifold of a multicylinder engine, which flow passages is extend to the terminal end of each intake manifold runner passage.

The flow passages of each network are preferably recessed by grooves formed into a mounting flange face of the manifold. The intake manifold itself is preferably of a molded composite plastic construction, in which case the grooves are molded into the flange face at the time the manifold is formed.

Each of the networks are supplied with a respective inlet opening for receiving the gas or vapor flows. These may include one or more fluids generated as a byproduct of engine operation, such as recirculated exhaust gas, crankcase vapors, and evaporative purge vapors from an adsorption canister.

An air assist flow can also be directed through another flow passage groove network in the flange face.

The grooves in the respective networks may be sealed from each other by means of seals disposed in grooves in the manifold flange face extending alongside either side of the respective flow passage grooves. The various grooves leading to particular engine cylinders are variously sized in cross sectional area increasingly proportionate to their relative length to produce balanced flow to each cylinder.

The resultant flow distribution pattern insures uniform volumes of each gas or vapor to each engine cylinder and eliminates the cost and complexity of much of the plumbing which otherwise would be required.

In the preferred form of the distribution system, the crankcase vapors and evaporative canister purge vapors are advantageously combined into a single flow network since they are compatible and have a complementary effect in keeping the grooves clear of lubricating oil sludge, the fuel vapors tend to flush out the heavier oil deposits left in the grooves by the crank case vapors.

DETAILED DESCRIPTION

Figure 1:
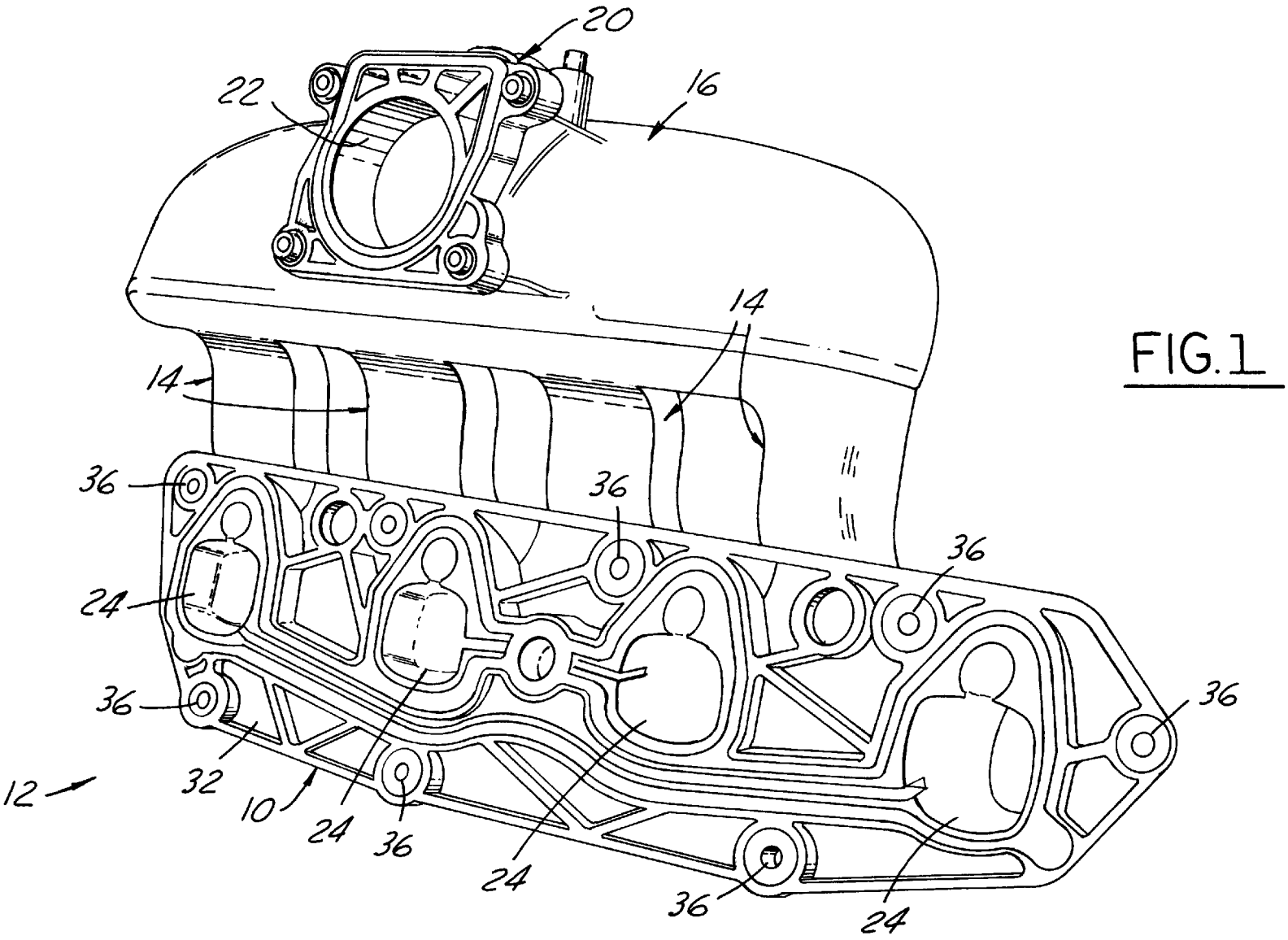
FIG. 1 is a perspective view of an intake manifold having an auxiliary flow passage network according to the invention.

In the following detailed description, certain specific terminology will be employed for the sake of clarity and a particular embodiment described in accordance with the requirements of 35 USC 112, but it is to be understood that the same is not intended to be limiting and should not be so construed inasmuch as the invention is capable of taking many forms and variations within the scope of the appended claims.

Referring to the drawings, the present invention provides a distribution system comprised of one or more auxiliary flow passage networks integrated into the mounting flange of an intake manifold 12. These networks are provided for distributing one or more of fluids generated as a byproduct of engine operation, such as crankcase vapors, fuel vapor contained in the absorption canister, or exhaust gas. A network can also be provided for distributing air assist flow to the fuel injectors as described in further detail below.

The intake manifold 12 is preferably of a molded composite plastic, having a series of individual runners 14 exiting from a plenum 16. The plenum 16 receives an air flow induced to flow into a throttle body 18 (FIG. 3B) mounted to flange 20 having an opening 22 entering into the interior of the plenum 16. A duct 19 connects to a remotely located air cleaner 17.

Figure 3A:
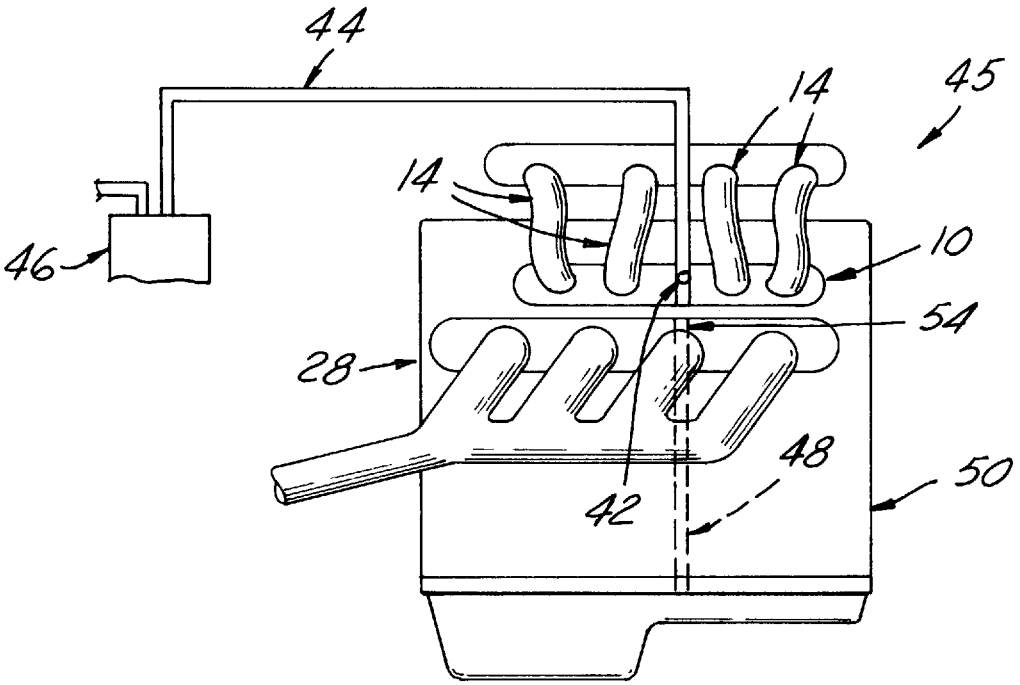
FIGS. 3A and 3B are diagrammatic end and side elevational views of an engine having an intake manifold providing an auxiliary flow passage network for receiving crankcase and canister vapors and directing a flow of both vapors to each individual cylinder.
Figure 3B:
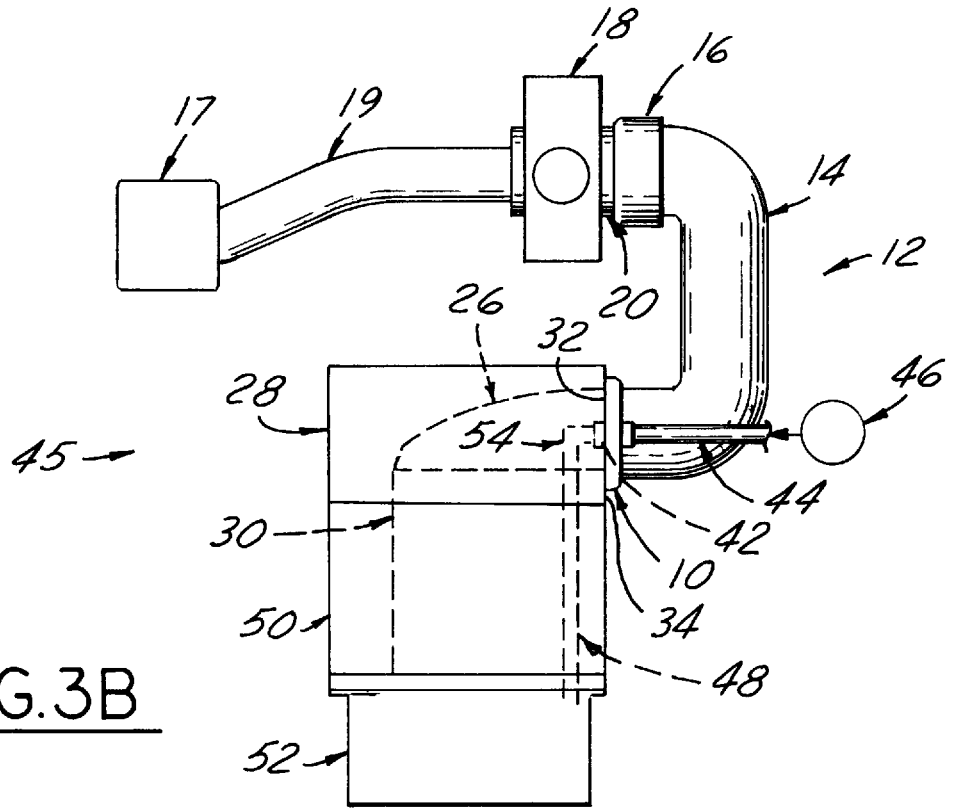

Each runner 14 has an internal passage which terminates in an individual manifold port 24 recessed into a manifold mounting flange 10, each manifold port 24 aligned with a respective one of a series of cylinder intake ports 26 formed along the cylinder head 28, each cylinder head port 26 in turn aligned with an engine cylinder 30 (FIG. 3B).

A fuel injector pocket 25 is adjacent each port 24, allowing a fuel injector (not shown) to spray a fuel charge into the air flow at timed intervals. It is noted that the fuel injector pockets could also be formed in the cylinder head in alternative designs.

The intake manifold mounting flange 10 has a mounting face 32 defined by a series of raised ribs adapted to be abutted against a cylinder head mounting surface 34. A series of mounting holes 36 with metal inserts receive studs (not shown), to allow the manifold to be mounted to the cylinder head surface 34.

The manifold plenum 16, runners 14, and ports 24 define the primary air distribution system for supplying a combustible mixture to the engine cylinders in conventional fashion.

Figure 2:
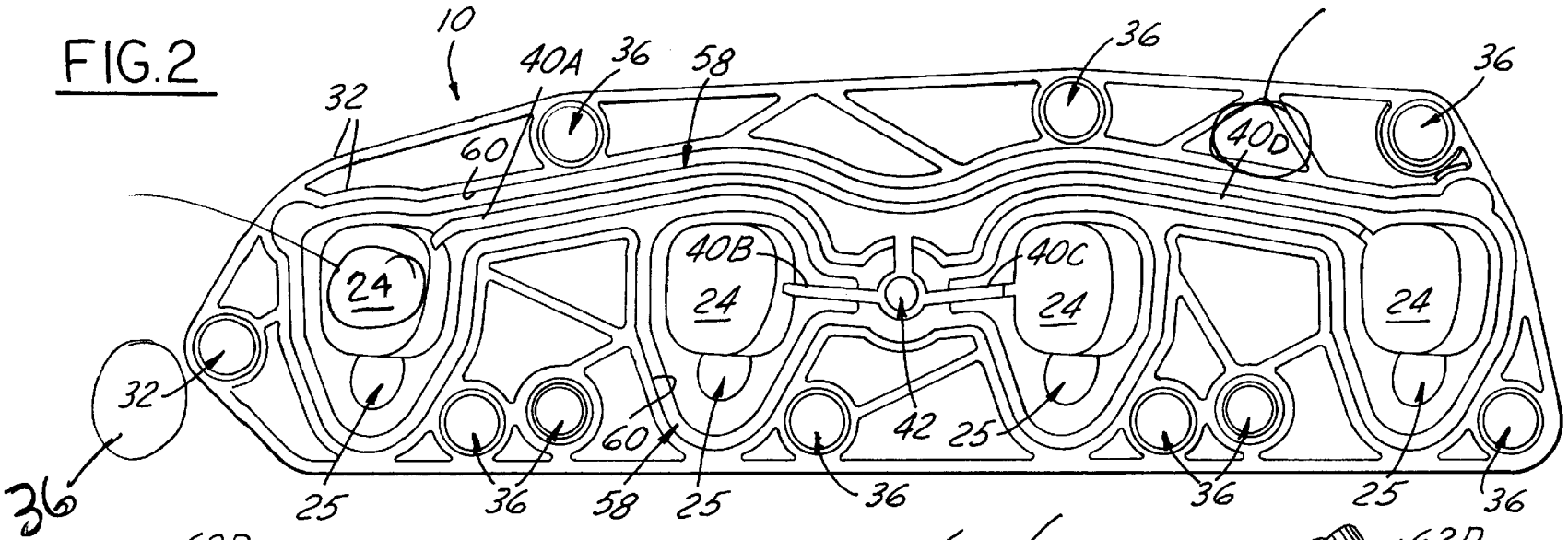
FIG. 2 is a front view of the mounting flange of the intake manifold shown in FIG. 1, showing the details of the auxiliary flow passage network.

According to the concept of the present invention, the intake manifold is provided with one or more auxiliary distribution systems, which in the embodiment shown in FIG. 2, consists of a network of flow passages 40A, 40B, 40C, 40D, each passage terminating in a respective manifold intake port 24. The flow passages 40A–40D are comprised of grooves recessed into the mounting face 32 of the manifold mounting flange 10.

The flow passages 40A–40D originate in an inlet opening 42 formed in flange 10 into which is introduced a byproduct vapor such as crankcase or purge vapors. In that instance, both vapors may be introduced into the same flow passage network, since there is a beneficial effect from both vapors flowing through the same distribution network.

This is indicated diagrammatically in FIGS. 3A and 3B. An external plumbing connection 44 from a multicylinder internal combustion engine 45 to an adsorption canister 46 directs a flow of purge vapors to the outside of inlet opening 42 in the flange 10. A cored passage 48 in the engine block 50 extends from the interior of the oil pan 52 to a second cored passage 54 in the cylinder head 28, which has a terminus aligned with the inlet opening of the network flow passages 40A–40D.

The flow passages 40A–40D are sealed on each side by an elongated elastomeric seal 58 received in a seal groove 60 which also encircles each intake port 24 to also act as a main sealing gasket for the manifold flange 10.

The flow passages 40A–40D are configured so as to present equal flow resistance, i.e., the cross sectional areas are increasingly proportional to their relative lengths, so as to balance fluid flow to each intake port 24.

While in the example described above, PCV and evaporative purge vapors are distributed to the engine cylinders, other byproduct fluids, such as recirculated exhaust gas, can be distributed in the same manner, either alternatively or in addition to the vapors.

Also, the air assist flow can be distributed to the injectors in this manner.

Figure 4:
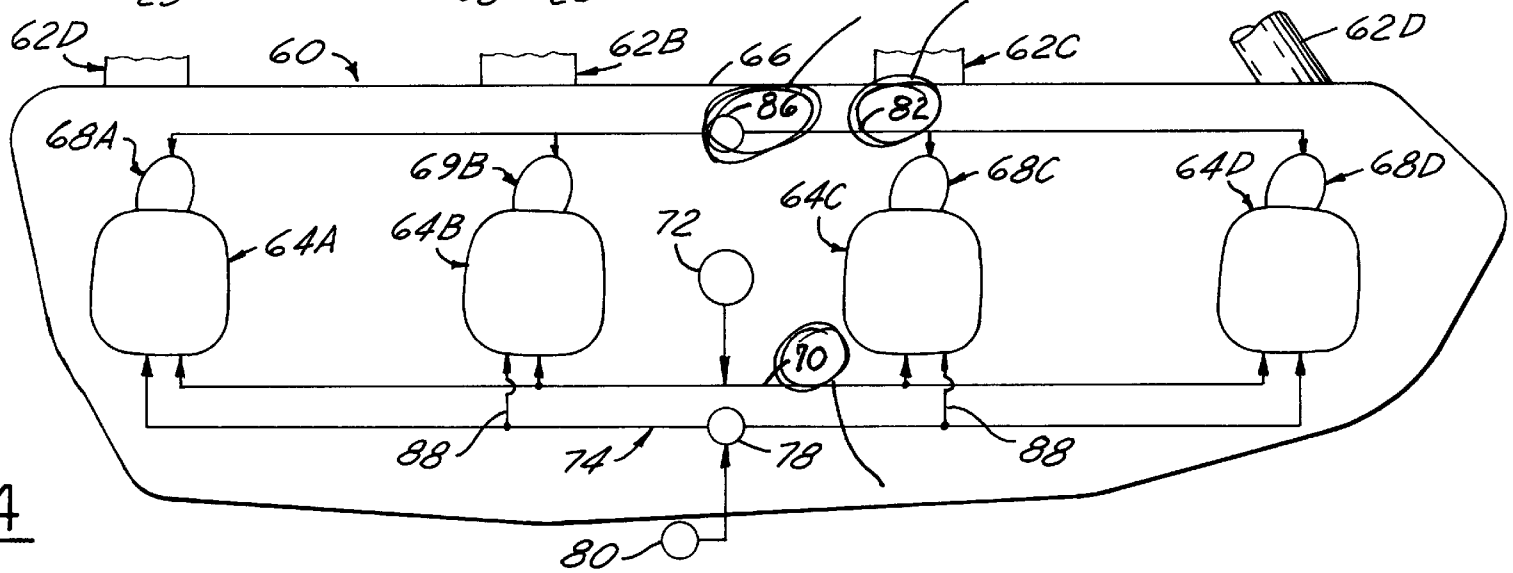
FIG. 4 is a diagrammatic representation of an intake manifold flange having a multiple flange passage network version of the present invention.

FIG. 4 diagrammatically shows such a system in which an intake manifold 50 has a plurality of runners 62A–62D leading to a corresponding series of cylinder port openings 64A–64D on the mounting flange 66. A series of injector seats 68A–68D are also provided as before.

According to this aspect of the invention, a series of flow passage networks are provided.

A first network 70 directs flow of fuel and crankcase vapors from a port 72 to each cylinder port opening 64A–64D.

A second network 74 directs flow of exhaust gas from a port 76 to each cylinder port 64A–64D, the exhaust gas received from a duct 78 from the exhaust gas recirculation valve 80.

A third network 82 directs a flow of assist air to each injector port 68A–68D, the air distributed from a port 86.

Each network 70, 74, 82 comprises a set of grooves in the flanges 68 sealed from each other. Small sections of passages 88 extending below the flange face will be necessary to avoid cross flows where the grooves of networks 70–74 cross.

Thus, an assured uniform distribution of each of the fluids and vapors is provided by a relatively low cost structure.

I claim:

1. In an internal combustion piston engine having an engine block and cylinder head defining a plurality of cylinders and an intake manifold for directing air inducted into said cylinders, said intake manifold having a mounting flange with a face secured against said engine, the improvement comprising:

an auxiliary fluid distribution system for directing a flow of an auxiliary fluid generated during operation of said engine into said engine cylinders, said auxiliary fluid distribution system including a first network of individual flow passages each extending to an intake port of a respective engine cylinder, and means for directing said auxiliary gaseous fluid into said first network of individual passages, said first network of flow passages comprising a series of grooves recessed into said intake manifold mounting flange so as to define said individual passages with said manifold face positioned against said engine.

2. The internal combustion engine according to claim 1 wherein the flow resistance of said individual flow passages in said first network are balanced to produce substantially equalized flow of auxiliary gaseous fluid to each cylinder.

3. The internal combustion engine according to claim 1 wherein said engine has a crankcase and said auxiliary gaseous fluid comprises crankcase vapors drawn into said first network of flow passages.

4. The internal combustion engine according to claim 3 further including a fuel vapor adsorption canister associated with said engine and wherein said canister is purged of said fuel vapor to generate an auxiliary gaseous fluid, said fuel vapors also directed into said first network of flow passages.

5. The internal combustion engine according to claim 2 further including a second network of flow passages each extending to said respective intake port of each engine cylinder, and wherein another source directs an auxiliary gaseous fluid into said second network of flow passages.

6. The internal combustion engine according to claim 5 wherein said another source of auxiliary gaseous fluid comprises engine exhaust gas directed into said second network of flow passages.

7. The internal combustion engine according to claim 1 further including a second network of flow passages, including a groove in said manifold flange face extending to each manifold intake port, said grooves in said first and second networks sealed from each other.

8. The internal combustion engine according to claim 6 wherein said engine includes a fuel injector for each engine cylinder and further including a third network of flow passages comprising grooves in said intake manifold mounting flange face each extending to a respective fuel injector, and means for directing a flow of assist air into said third network of flow passages.

* * * * *